US006623207B2

(12) United States Patent
Grubba et al.

(10) Patent No.: US 6,623,207 B2
(45) Date of Patent: Sep. 23, 2003

(54) METHOD OF UPGRADING GRAVEL AND/ OR DIRT ROADS AND A COMPOSITE ROAD RESULTING THEREFROM

(75) Inventors: Bill Grubba, Terre Haute, IN (US); Todd Thomas, Bel Aire, KS (US); Dan Wegman, Inver Grove Heights, MN (US)

(73) Assignee: KMC Enterprises, Inc., Wichita, KS (US)

( * ) Notice: Subject to any disclaimer, the term of this patent is extended or adjusted under 35 U.S.C. 154(b) by 70 days.

(21) Appl. No.: 09/876,801

(22) Filed: Jun. 7, 2001

(65) Prior Publication Data

US 2002/0197109 A1 Dec. 26, 2002

(51) Int. Cl.[7] ..... E01C 7/32
(52) U.S. Cl. ..... 404/76; 404/75
(58) Field of Search ..... 404/72, 75, 76, 404/77, 90, 92

(56) References Cited

U.S. PATENT DOCUMENTS

| | | | | | |
|---|---|---|---|---|---|
| 3,598,027 | A | * | 8/1971 | Swisher, Jr. | 404/76 |
| 3,732,023 | A | * | 5/1973 | Rank et al. | 404/111 |
| 3,970,404 | A | * | 7/1976 | Benedetti | 404/77 |
| 4,373,961 | A | * | 2/1983 | Stone | 106/281.1 |
| 4,453,856 | A | * | 6/1984 | Choistri et al. | 404/108 |
| 4,473,320 | A | * | 9/1984 | Register | 404/101 |
| 4,549,834 | A | | 10/1985 | Allen | |
| 4,793,730 | A | * | 12/1988 | Butch | 404/77 |
| 4,946,307 | A | * | 8/1990 | Jakob | 404/90 |
| 5,741,085 | A | * | 4/1998 | Wirtgen | 404/75 |
| 5,817,946 | A | | 10/1998 | Brovold | |
| 5,893,677 | A | * | 4/1999 | Haehn et al. | 299/39.4 |
| 5,895,347 | A | | 4/1999 | Doyle | |
| 6,000,876 | A | | 12/1999 | Shen et al. | |
| 6,004,076 | A | | 12/1999 | Cook et al. | |
| 6,089,783 | A | | 7/2000 | Goacolou | |
| 6,158,920 | A | | 12/2000 | Malot | |
| 6,176,551 | B1 | * | 1/2001 | Page | 172/684.5 |
| 6,186,700 | B1 | * | 2/2001 | Omann | 404/79 |
| 6,220,782 | B1 | * | 4/2001 | Yates | 404/75 |
| 6,387,175 | B1 | | 5/2002 | Lynn et al. | |

OTHER PUBLICATIONS

Holtz and Kocacs, An Introduction to Geotechnical Engineering, 1981, pp. 1–4.*

Wright and Ashford, Transportation Engineering, 1989, pp. 405–408.*

Wirtgen Cold Recycling Manual, Nov. 1998.

* cited by examiner

*Primary Examiner*—Gary S. Hartmann
(74) *Attorney, Agent, or Firm*—Stinson Morrison Hecker L.L.P.

(57) ABSTRACT

A method of paving a gravel and/or dirt roadway is provided. This method includes evaluating the roadway to determine if it is an appropriate candidate for emulsion stabilization, rotating a milling head down a roadway to break up gravel and dirt, injecting an asphalt emulsion into the broken up gravel and dirt, and mixing the emulsion with the gravel and dirt so as to form an emulsion stabilized layer. The emulsion stabilized layer is then spread and compacted to create a paved roadway. Following this, a wearing surface may be applied to the emulsion stabilized layer.

25 Claims, 5 Drawing Sheets

METHOD OF UPGRADING GRAVEL AND/OR DIRT ROADS AND A COMPOSITE ROAD RESULTING THEREFROM

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

The present invention relates to reconstructing and paving roads. More specifically, the present invention is a method for designing and building a road using in-place ground components rather than removing and replacing them.

Currently, when roads are re-built, materials such as stone, dirt, and gravel are often excavated and removed. Then, aggregate base material and hot mix asphalt are brought to the construction site, and multiple layers are placed on the cleared area. One disadvantage with such a process is that it is time consuming because it requires two operations. In one operation, a dirt or gravel road is broken up, and the material is removed. Then, in the second operation, the aggregate and asphalt are transported to the site and placed on the excavated surface.

Another disadvantage with such a process is that it is expensive. The traffic levels expected on a road for years into the future must be projected so that the necessary thickness and strength of road is built. It is difficult to project future traffic levels and so the road may be over designed by making the road too thick. Alternatively, too weak or too narrow of a road is built, and the road must be rebuilt using this expensive process in just a few years.

Still another disadvantage with such a process is that multiple layers of pavement may need to be placed on a roadway to provide sufficient structural support for the loads to be supported by the roadway. In many circumstances, this necessitates the roadway to be built up higher than what is safe or practical. If a sufficient thickness of asphalt is not placed on the roadway, the road will break up quickly.

In many instances, the height of the road can be raised only if the shoulders and areas beyond are raised and meet slope requirements. Also, there is often no space for widening the road because it extends beyond the existing right-of-way requiring land adjacent to the road to be purchased and causing additional expense.

In order to overcome these disadvantages, a method for designing and building a new roadway using in-place materials from the existing roadway is provided. This allows a road to be built downward instead of upward with limited additional height added.

SUMMARY OF THE INVENTION

It is an object of the present invention to provide a method for reconstructing a dirt or gravel roadway to create a paved roadway of desired thickness without the need to increase the height of the paved roadway beyond acceptable levels so that the road meets structural requirements for existing and future traffic levels without significant profile or geometric changes.

Another object of the present invention is to provide a method for making a road that uses materials currently in the roadway so that cost savings for materials are realized and time for moving the materials is reduced.

According to the present invention, the foregoing and other objects are achieved by a method of stabilizing a gravel and/or dirt roadway. This method includes evaluating a roadway to determine if it is an appropriate candidate for emulsion stabilization, rotating a milling head along a roadway to break up gravel and dirt, injecting an asphalt emulsion into the broken up gravel and dirt, and mixing the emulsion with the gravel and dirt so as to form an asphalt emulsion stabilized layer. The emulsion stabilized layer is then spread and compacted to create a paved roadway. Following this, a wearing surface or surface treatment may be applied to the emulsion stabilized layer.

Additional objects, advantages, and novel features of the invention will be set forth in the description that follows and in part will become apparent to those skilled in the art upon examination of the following, or may be learned by practice of the invention.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENT

Figure 1:
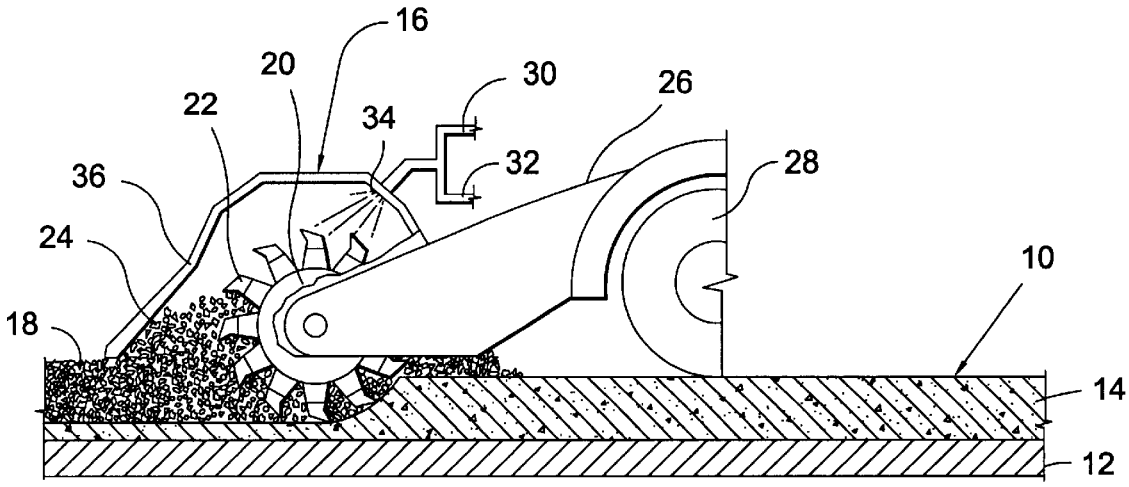
FIG. 1 is a cross-sectional view of a milling head milling up a gravel and/or dirt roadway and creating an asphalt emulsion stabilized layer of the present invention.

Referring to FIG. 1, a gravel or dirt roadway to be paved is broadly designated by the reference numeral 10. This roadway includes a subgrade layer 12 that is comprised of naturally occurring soils and a gravel and/or dirt base layer 14. Through the method of the present invention using an apparatus 16, an emulsion stabilized layer 18 is created. Apparatus 16 is a reclaimer and includes a milling head 20 with teeth 22 which break up base layer 14, and sometimes break up part of layer 12, into loose material (gravel/dirt) 24 so as to begin re-profiling roadway 10. As shown in FIG. 1, apparatus 16 travels to the right of the page. Milling head 20 is connected to a motorized unit 26 which has a wheel 28. Apparatus 16 also includes a line 30 for carrying asphalt emulsion and a line 32 for carrying water. The emulsion and sometimes the water are to be sprayed onto gravel/dirt 24 through a spray bar 34, which is connected to lines 30 and 32. A mixing chamber 36, which is part of apparatus 16, keeps the gravel/dirt 24, emulsion, and water in a confined area so that they can be mixed thoroughly. Spray bar 34 extends the width of the mixing chamber 36. The bottom edge of mixing chamber 36 acts to spread the newly created emulsion stabilized layer 18. A motor grader may also be used to spread layer 18. Layer 18 is then compacted to increase its density using a roller. Following this, a wearing surface or surface treatment may be placed over layer 18.

Figure 2:
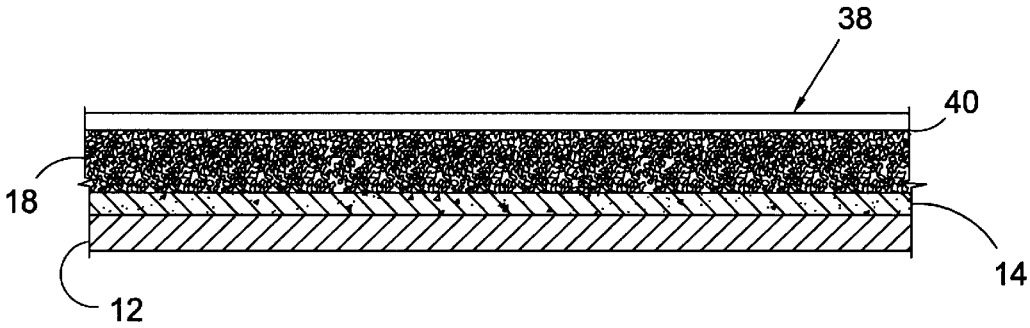
FIG. 2 is a cross-sectional view of the roadway of the present invention after the method of the present invention has been performed.

The finished road is shown in FIG. 2 and is broadly designated by the reference numeral 38. It includes subgrade layer 12, gravel/dirt base layer 14, which has been at least partially incorporated into layer 18, emulsion stabilized layer 18, and wearing surface 40.

In an alternate embodiment of the invention, a thin asphalt layer (not shown) may be on gravel/dirt base layer 14 before the method of the present invention is started. This layer may be comprised of hot mix, cold mix, or built-up chip seals. If this layer is about 2 inches or less, then it may be broken up along with the gravel/dirt base layer 14 and combined with emulsion to form emulsion stabilized layer 18. Preferably, the broken up thin asphalt layer is about one-third or less of the emulsion stabilized layer.

The method of the present invention uses a one unit type of machine. Preferably, a CAT RM-350 from Caterpillar or equivalent machine is used. This machine is a self-propelled reclaimer able to fully mill the existing gravel or dirt base to the depth required, incorporate the emulsion and water, and mix the materials to produce a substantially homogeneous material. Most preferably, the machine is capable of processing not less than about 8-ft. (2.4 m) wide and about 12-inches deep of roadway in each pass. Preferably, the reclaimer travel speed and milling head speed shall have the capability to be adjusted independently. Also, the reclaimer preferably has a visible depth gauge to allow for determination of the depth of pulverization and mixing. Preferably, the reclaimer also has a system for adding emulsion with a full width spray bar that includes a positive displacement pump interlocked to the machine speed so that the amount of emulsion being added is automatically adjusted with changes in machine speed.

The asphalt emulsion in line 30 is a blend of asphalt, water, emulsifier, and possibly additives. It is liquid at ambient temperature. The specific formulation of the emulsion can vary depending upon the properties to be achieved. For instance, it can be formulated to set up quickly. It also can be formulated to improve the coating of the gravel/dirt 24 to result in less cracking of the roadway or to improve the strength of the roadway. The type of asphalt emulsion used shall be determined by the mixture design, discussed infra. Preferably, the emulsifier is a lignon tofa reacted amine.

The emulsion is added to the blend of reclaimed materials (gravel/dirt 24). Optionally, water may also be added through line 32, as it may be needed to cool the milling head and to aid in the dispersion of the emulsion. Preferably, the emulsion includes about 0.5 to 10% by weight emulsifier, about 60 to 65% by weight asphalt solids, water, and optionally certain additives. The additives may be 0.5 to 10% by weight of the emulsion and may include elastomers, plastomers, other adhesion agents, and petroleum fractions. Depending on which additives are used, these additives can be added to the asphalt solids or to the emulsion to make modified asphalts, including polymer modified asphalt.

Preferably, the asphalt emulsion system on the reclaimer is capable of incorporating up to about 7 gallons per square yard of liquid asphalt emulsion and is able to deliver within about 0.2 percent of the target percent. The liquid metering system of the reclaimer preferably has a flow meter, spray bar and nozzles, and a meter measuring the forward speed of the machine in feet per minute. A water truck for supplying water to the reclaimer machine may be needed during the pulverization operation to supply additional moisture.

An entire process for inexpensively paving or repairing a gravel, dirt, or thinly paved asphalt road is provided. The process involves creating adequate structure through in-place stabilization of the existing roadway, thus avoiding the costly requirement of widening the road and/or slope corrections associated with adding significant structure. The asphalt emulsion base stabilization method of the present invention includes reclaiming a desired width and depth of the existing gravel and/or dirt base with a reclaimer. The method of the present invention provides structure so that no more than 2 inches of surfacing is needed. Apparatus 16 grinds the existing gravel/dirt road to the required depth, adds an emulsion to the loosened gravel/dirt 24 while grinding, and spreads the gravel/dirt/emulsion mixture in place for further spreading and compaction. The loosened gravel/dirt 24 is wetted and coated by the emulsion. The emulsion is mixed with gravel and/or dirt in the mixing chamber 36 to form an emulsion stabilized mixture. Additional aggregate may be added to the road before processing if needed. The emulsion stabilized mixture (bituminous material) is spread and compacted, and an emulsion stabilized layer 18 is obtained. The emulsion stabilized layer 18 is no more than about six inches thick. A road constructed according to the present invention sets up at a faster rate than when using a conventional process, allowing traffic on it sooner and allowing placement of a wearing surface or surface treatment sooner.

After the emulsion stabilized layer 18 has set up, a wearing surface 40, can be placed thereon. The wearing surface may be a cold, hot, or warm mix overlay, a sealcoat, a chip seal, a fog seal, or other surface treatment. Preferably, the wearing surface is no more than about two inches thick.

Figure 3:
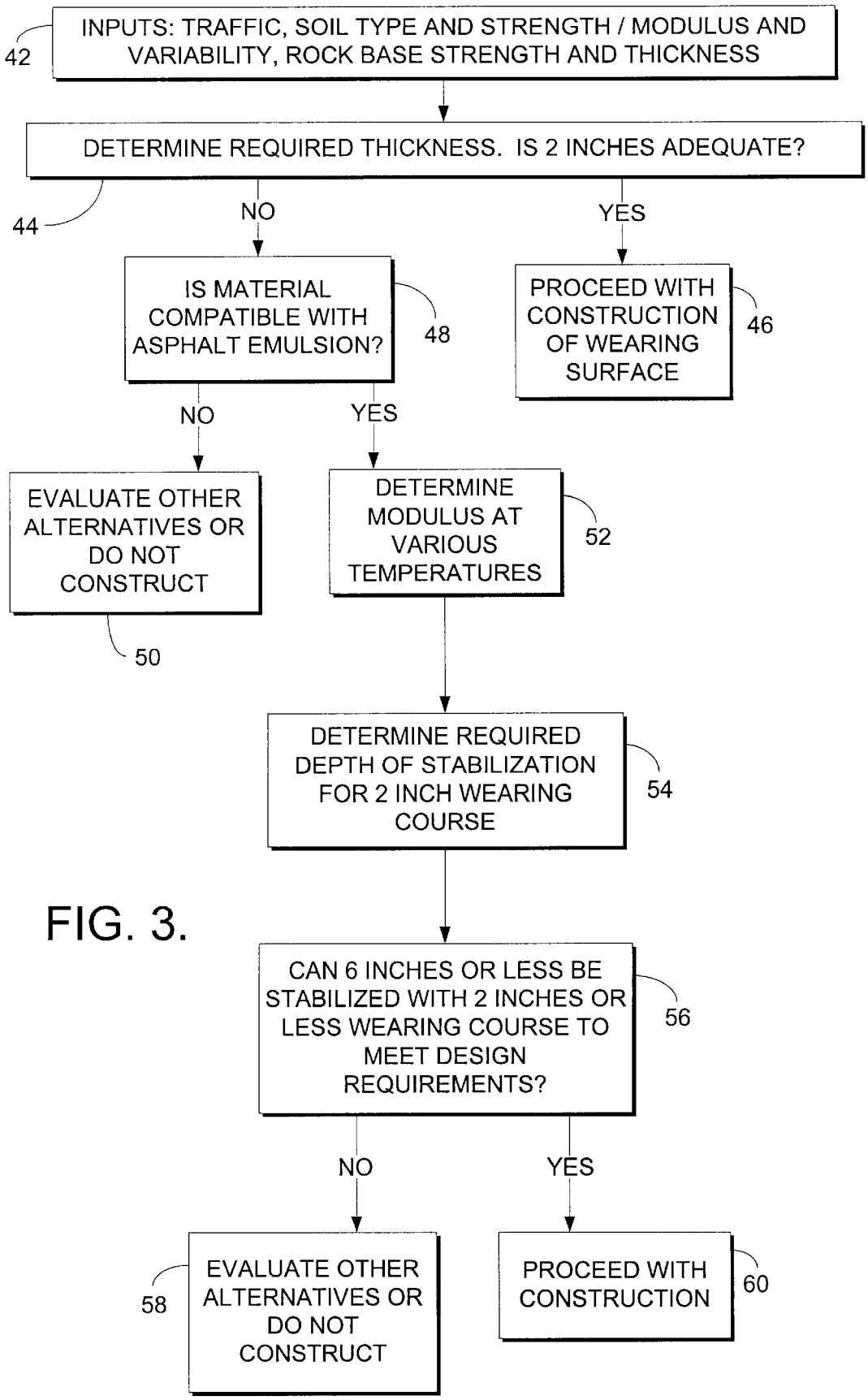
FIG. 3 is a flow diagram summarizing the evaluation process of FIGS. 4, 5, and 6 for determining if a roadway is an appropriate candidate for emulsion stabilization.

A summary of the evaluation process of the present invention is shown in FIG. 3. In order to evaluate if emulsion stabilization is the correct treatment for stabilizing a road, variables such as traffic, soil type (strength/modulus and variability), and rock base strength and thickness 42 must be measured. The required thickness of the road to support the traffic must be determined. The soils, existing rock base material, traffic loads, emulsion type and strength improvement must be evaluated to determine if the gravel/dirt roadway is an appropriate candidate for base stabilization. In some cases, it may not be possible to limit stabilization to no more than six inches (upper limit for the emulsion stabilized layer 18) with a two inch wearing surface, due to poor soil conditions and/or high traffic loads. In this case, other additives should be investigated, or other methods of rehabilitation should be considered, such as removing existing soil and replacing it with higher quality material.

If the required thickness of the wearing surface is two inches or less 44 after the evaluation of the base layer of the roadway, then one may proceed with construction of the wearing surface 46. If it is not less than two inches, then it must be determined if the in-place material is compatible with the asphalt emulsion 48. If it is not compatible with the asphalt emulsion, meaning that adequate coating and dispersion are not achieved, then the material is not appropriate for the present invention 50. If it is compatible, then the modulus at various temperatures needs to be determined 52. After the asphalt emulsion is designed, the depth of stabilization with the asphalt emulsion for a two inch wearing surface needs to be determined 54.

It next needs to be determined if six inches or less of emulsion stabilized gravel and dirt with two inches or less wearing surface can meet design requirements 56. If it cannot, then other alternatives must be evaluated or the method of the present invention cannot be used 58. If it can, then one can proceed with construction 60. Thicknesses of more than about 2 inches of wearing surface may be hazardous and thus undesirable from a safety standpoint.

Figure 4:
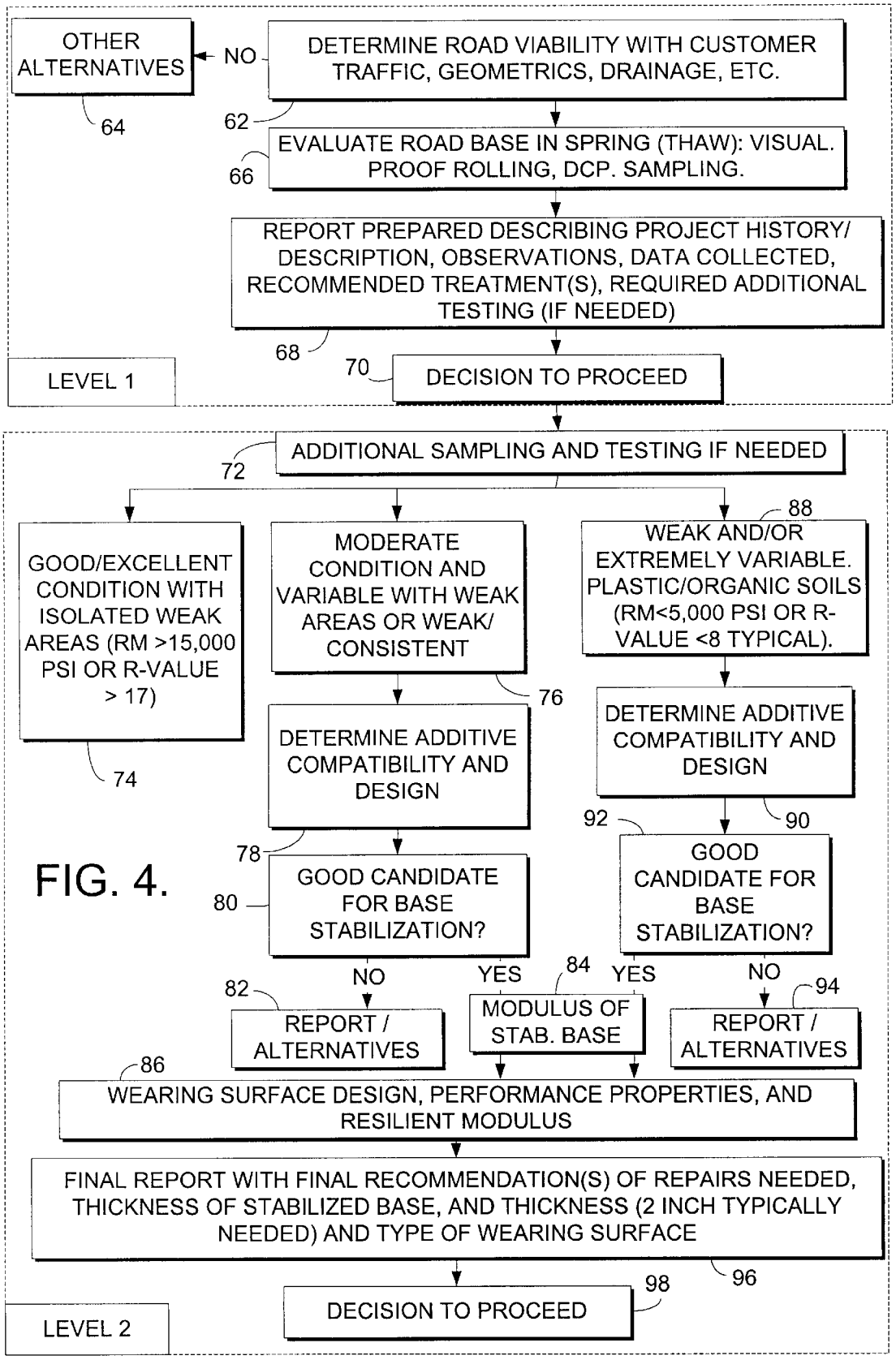
FIG. 4 is flow diagram of how an unpaved road is evaluated in accordance with the method of the present invention.

A more detailed process for evaluating the unpaved road is shown in FIG. 4. The first step is to evaluate the unpaved road, including traffic levels, geometries, drainage, etc., to determine the overall viability of doing the process 62. Next, the road base is more thoroughly evaluated, preferably during spring thaw 66. This is when the most water is in the road base layer and subgrade layer. This is a visual evaluation. Visual analysis includes inspecting geometries, culverts, road history, drainage, and soft areas. The road structure evaluation includes testing the road with a Dynamic Cone Penetrometer (DCP) preferably each half-mile and proof-rolling as needed. Following this, it is decided whether or not the road is an appropriate candidate for the base stabilization process of the present invention 70.

If it is an appropriate road for base stabilization, additional sampling and testing, if needed, are performed 72. Borings are taken preferably each half mile and tested for resilient modulus or R value. Testing by Falling Weight Deflectometer (FWD) or DCP can be performed, as needed, to determine resilient modulus of more areas of the road, such as isolated areas. If the road is in good/excellent condition with isolated weak areas (Resilient Modulus (RM) greater than 15,000 psi or R value (measures strength) greater than 17) 74, then it is appropriate to determine a wearing surface design. If the road is in moderate condition and variable with weak areas or weak consistent areas 76, then emulsion compatibility and design 78 must be performed to determine whether the material is a good candidate for base stabilization 80. If it is, the modulus of the stabilized base must be determined 84. Following this, wearing surface design with its performance properties and resilient modulus 86 is determined. If the road is weak or extremely variable, such as containing plastic or organic soils (RM less than 5,000 psi or R value less than 8 typically) 88, then emulsion compatibility and design 90 must be determined.

Next, it must be determined if the material is a good candidate for base stabilization 92. If it is, the modulus of the stabilized base 84 must be determined, and then the wearing surface design including its performance properties and resilient modulus 86 is determined. Typically, the thickness of the wearing surface is about two inches 96. Next, recommendations for repairs must be made.

Figure 5:
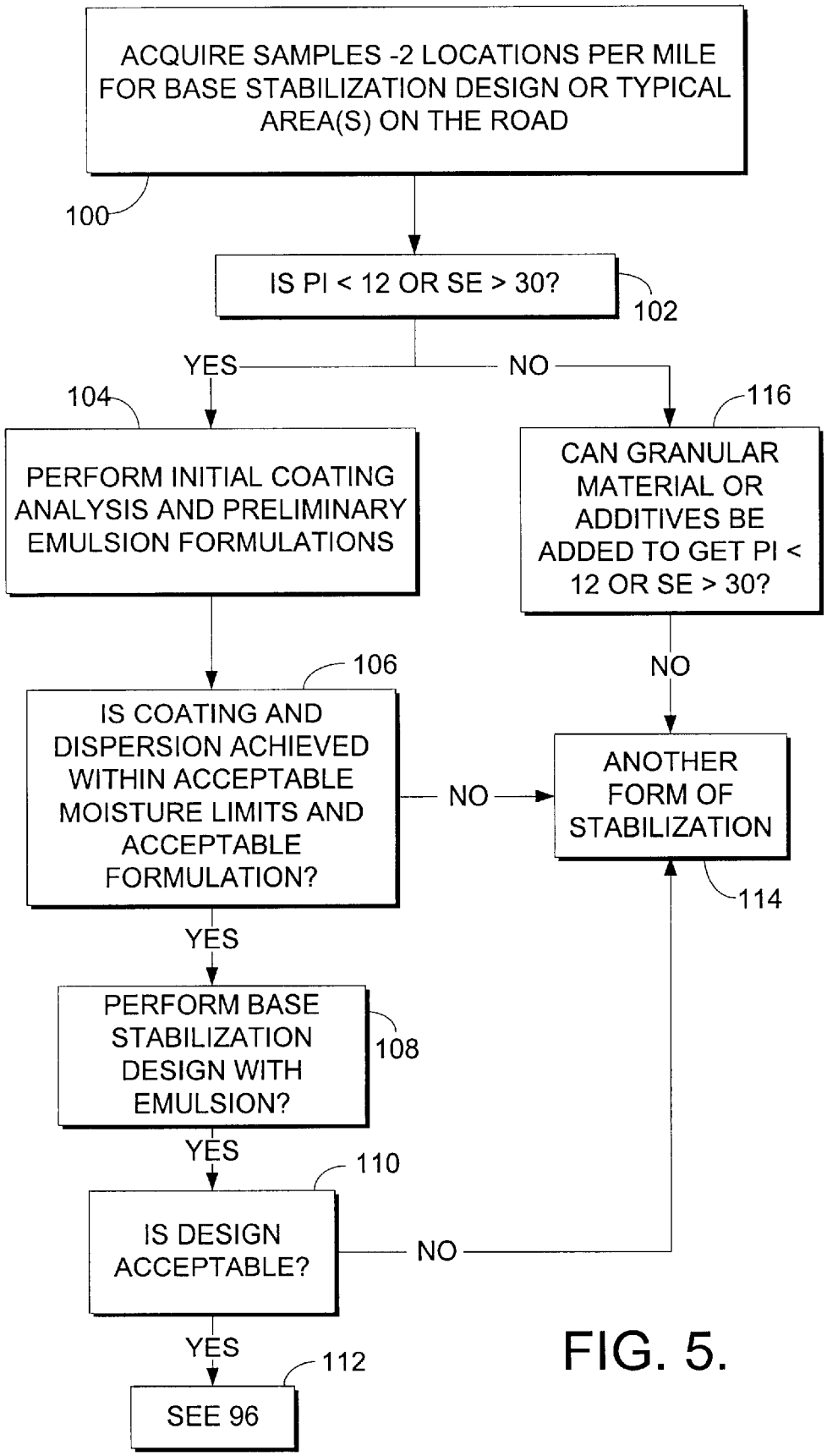
FIG. 5 is a flow diagram of a process for determining the base stabilization design using an emulsion in accordance with the method of the present invention.

A description of the base stabilization with emulsion design is shown in FIG. 5. Optimally, samples are acquired at two locations per mile for base stabilization design 100.

If the Plasticity Index (PI) is less than 12 or the Sand Equivalence (SE) is greater than 30 (reference numeral 102), then initial coating analysis and preliminary emulsion formulations 104 are determined. Next, it is determined if the coating and dispersion achieved are within acceptable moisture limits and acceptable formulations 106. If so, a base stabilization design with emulsion is performed 108. Following this, if the design is acceptable 110, then one may proceed with designing the thickness of the road structure 112. If not, then another form of stabilization must be evaluated 114.

If the PI is not less than 12 or the SE is not greater than 30 (reference numeral 102), then it must be determined if aggregate or additives can be added to get the PI less than 12 or SE greater than 30 (reference numeral 116). Aggregate or additives shall be incorporated at rates in which they are determined to be needed. If they cannot be incorporated, then another form of stabilization must be evaluated 114. The type and quantity of water and asphalt emulsion used to form the emulsion stabilization layer is determined by the mixture design. The stabilization design includes providing an optimum emulsion content that is compatible with the in-place material and that retains sufficient strength in the presence of water and determining if adding aggregate is necessary for the stabilization design. Optionally, chemicals such as $CaCl_2$, lime, cement, fly ash, or combinations thereof may be added to the emulsion stabilized mixture. Preferably, the asphalt emulsion is formulated for optimal compatibility with the gravel and/or dirt. This allows for better coating for durability and a quicker cure time for the emulsion stabilized layer, which allows traffic to be returned to the roadway quicker and allows a wearing surface to be place on the emulsion stabilized layer quicker. The emulsion stabilized mixture, including aggregate and additives added, if any, at the recommended design shall have properties as indicated in Table 1.

TABLE 1

100 mm diameter specimens shall be prepared in a Superpave ™ gyratory compactor meeting the specifications of the Strategic Highway Research Program

| Property | Criteria |
|---|---|
| Superpave ™ gyratory compaction, 1.25° angle, 600 kPa, gyrations | 30 |
| Coating test, Method TXDOTD TR 317-87, min., % (using a hot mix testing method to test the emulsion stabilized material) | 80 |
| Initial Marshall stability after 24 hours, ASTM D 1559, 25° C., min., lb | 1800 |
| Cured Marshall stability*, 25° C., min., lb | 2500 |
| Conditioned Marshall stability* after soaking, 25° C., min., lb | 1000 |

*Cured stability determined at 25° C. on 60° C. cured to constant weight (<48 hours).
Conditioned stability determined after cured, 55–75% vacuum saturation, 24 hour water soak at 25° C.

Figure 6:
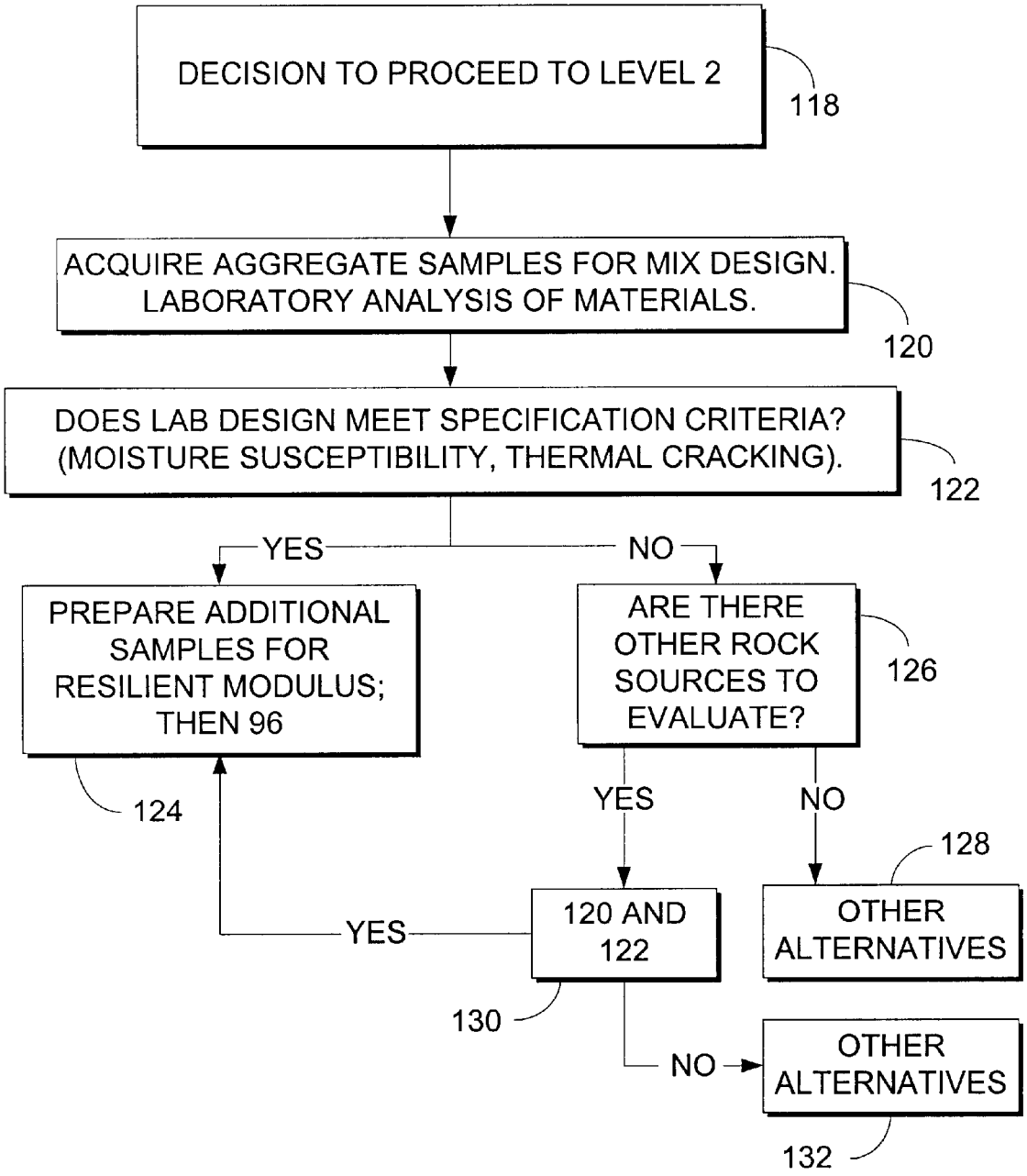
FIG. 6 is a flow diagram of a process for designing a wearing surface in accordance with the method of the present invention.

Next, the wearing surface mix is designed, as shown in FIG. 6. Aggregate samples are acquired for mix designs, and these samples are analyzed in the lab 120. Appropriate aggregate samples are combined with an asphalt, an emulsion, or combinations thereof to form a cold mix, warm mix, or hot mix. If the lab design of the cold mix, warm mix, or hot mix meets specification criteria for moisture susceptibility and thermal cracking 122, then additional samples are prepared to determine resilient modulus 124. The specification criteria of these samples is shown in Table 2.

TABLE 2

| Property | Criteria |
|---|---|
| 100 mm diameter specimens for moisture susceptibility testing shall be prepared in a Superpave ™ gyratory compactor meeting the specifications of the Strategic Highway Research Program | |
| Superpave ™ gyratory compaction, 1.25° angle, 600 kPa, gyrations | 30 |
| Retained stability based on cured stability, min., % * | 70 |

TABLE 2-continued

| Property | Criteria |
|---|---|
| 150 mm diameter specimens for thermal crack testing shall be prepared in a Superpave ™ gyratory compactor meeting the specifications of the Strategic Highway Research Program | |
| Indirect Tensile Test (IDT), modified AASHTO TP9-96 ** | See note ** |

* Cured stability (ASTM D 1559) determined at 40° C. on 60° C. cured to constant weight (<72 hours). Conditioned stability determined after cured, 55–75% vacuum saturation, 24 hour freeze, 23 hour water soak at 25° C., and 1 hour soak at 40° C. Retained stability, % = conditioned stability × 100/cured stability

** Tested on specimens +/− 1% air voids from stability specimens, cured <72 hours. The IDT testing device must be capable of temperatures down to −40° C. Specification temperature shall be chosen using FHWA LTPP-Bind software (Version 2.1) using the weather station closest to the project. The required temperature for the specification is the coldest temperature at the top of the emulsion stabilized layer in the pavement structure. Use 98 percent reliability for temperature selection.

Thermal cracking requirements are specific to the climate in which the project is constructed. If the samples do not meet specification criteria then other rock sources are evaluated 126. If another rock source is not available, then other alternatives 128 must be pursued. Once desirable aggregate is found and the resilient modulus is determined, then the road design is continued 124.

The emulsion stabilized mixture, which includes base material, emulsion, and water shall meet the following gradation requirements prior to spreading during construction: about 97–100% passing through a sieve that is 1.75 inches (44 millimeters). Preferably, the emulsion stabilized mixture includes up to about 8% by weight emulsion. Most preferably, it includes about 4–8% by weight emulsion. As discussed previously, the emulsion includes about 0.5–10% by weight emulsifier, and 60–65% by weight asphalt solids, water and possibly other additives. The optimum moisture content and emulsion content, determined from the mix design, are used. The emulsion stabilized layer is about six inches or less thick.

After completion of the first pass, the emulsion stabilized layer shall be evened, aerated, spread, and shaped to the designed contour with a motor grader. Following this, the emulsion stabilized layer is compacted with rollers. A regular or vibratory-type roller may be used. It may have a pad foot drum, a smooth faced drum, pneumatic wheels thereon, or combinations thereof After completion of any rolling, any remaining pad foot marks shall be removed using a motor grader cut to approximately the depth of the pad foot. The bladed material shall be spread and re-compacted with a roller.

Nuclear density testing shall be performed on a test strip at the start of the project to establish roller patterns for maximum achievable density. All subsequent paving shall be compacted to a preferred minimum of about 97% density of the test strip average density. If displacement is still occurring, rolling shall be performed until no displacement is occurring or until the rollers are walking out of the mixture. Wet density shall also be determined, preferably at a minimum about every 3500 square yards, using a properly calibrated nuclear moisture density instrument.

Heavy construction equipment should not drive on the stabilized base until the pavement is firm and will not deform or rut. After opening the road to traffic, the surface of the stabilized base shall be maintained in a condition suitable for the safe movement of traffic. This shall include the removal of unacceptable loose particles by sweeping them away with a power broom. If the reclaimed mix does not appear to be adequately mixed or homogenous, additional mixing passes shall be completed with a reclaimer until desired uniformity is achieved. Before placing any wearing surface on the emulsion stabilized layer, the layer should be allowed to cure until the moisture content of the mixture is reduced to 2.5% or less by dry weight of mixture or until it is determined that the material is firm enough for surfacing.

The method of the present invention is especially desirable for paving rural dirt and gravel roads that may not have hot mix plants nearby. The entire operation of incorporating aggregate, water, and emulsion, and spreading can be completed in one pass. Preferably, the process of the present invention is performed at or above about 60° F. (15° C.). Preferably, no fog or rain is present. Preferably, there are no freezing temperatures within 48 hours after placement of any portion of the project. The life of the road created is approximately ten years, depending on traffic growth.

From the foregoing, it will be seen that this invention is one well adapted to attain all the ends and objects herein above set forth together with other advantages which are obvious and inherent to the method. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

We claim:

1. A method of reconstructing a roadway comprising gravel, dirt, or a combination thereof using a milling head and an asphalt emulsion, said method comprising:

evaluating said roadway to determine if said roadway is an appropriate candidate for emulsion stabilization, wherein said evaluating step includes measuring traffic levels, soil type, rock base strength and thickness of said roadway and determining the depth of base stabilization needed to support traffic;

taking borings of said roadway;

analyzing said borings determining if said gravel or dirt is compatible with said asphalt emulsion;

determining the amount of said emulsion that is compatible with said roadway and retains desired strength;

rotating said milling head along said roadway, wherein said milling head breaks up said gravel or dirt;

injecting said asphalt emulsion into said broken up gravel or dirt; and mixing said emulsion with said gravel or dirt so as to form an emulsion stabilized mixture.

2. The method of claim 1, further comprising:

spreading said emulsion stabilized mixture to form an emulsion stabilized layer; and compacting said emulsion stabilized layer to increase the density of said layer.

3. The method of claim 1, wherein said gravel and dirt is wetted and coated with said asphalt emulsion during said mixing step.

4. The method of claim 1, further comprising:

adding aggregate to said emulsion stabilized mixture during said mixing step.

5. The method of claim 1, wherein said roadway is further comprised of a thin asphalt layer that is maximum of 2 inches thick, wherein said milling head breaks up said thin asphalt later during said rotating step, wherein said emulsion is mixed with said gravel, dirt and asphalt, and wherein said asphalt is no more than about one-third of said emulsion stabilized mixture.

6. The method of claim 1, further comprising:

allowing said emulsion stabilized layer to set; and applying a wearing surface over said emulsion stabilized layer after said layer has set.

7. The method of claim 6, wherein said emulsion stabilized layer is allowed to set until the water content is no more than 2.5% by dry weight before said wearing surface is applied.

8. The method of claim 1, further comprising:

adding water to said emulsion during said injecting step or said mixing step.

9. The method of claim 1, further comprising:

adding one or more chemicals selected from the group consisting of $CaCl_2$, lime, cement, and fly ash to said emulsion stabilized mixture during said mixing step.

10. The method of claim 1, wherein said evaluating step further includes:

visually analyzing said roadway to determine geometries, culverts, road history, and drainage during spring thaw.

11. The method of claim 10, further comprising:

(a) determining the plasticity index or sand equivalence of said broken up gravel or dirt of said milled roadway;

(b) determining an emulsion stabilized layer design; and (c) making repairs and drainage corrections to said roadway as needed.

12. A method of reconstructing a roadway comprised of a base layer of gravel, dirt, or a combination thereof and further comprised of a subgrade layer of soil by using a milling head and an asphalt emulsion to base stabilize said roadway, said method comprising:

(a) measuring traffic levels, soil type, rock base strength and thickness of said roadway;

(b) visually analyzing said roadway to determine geometries, culverts, road history, and drainage during spring thaw;

(c) taking borings of said roadway;

(d) analyzing said borings;

(e) determining if said base layer is compatible with said asphalt emulsion;

(f) analyzing said subgrade layer of soil;

(g) determining the depth of base stabilization needed to support traffic;

(h) determining the plasticity index or sand equivalence of said gravel or dirt of said roadway;

(i) determining the amount of said emulsion that is compatible with said roadway and retains desired strength;

(j) determining an emulsion stabilized layer design;

(k) making repairs and drainage corrections to said roadway as needed;

(l) rotating said milling head along said roadway, where in said milling head breaks up gravel or dirt;

(m) injecting said asphalt emulsion into said broken up gravel or dirt;

(n) mixing said asphalt emulsion with said gravel or dirt so as to form an emulsion stabilized mixture; and (o) ensuring that at last 97% of said emulsion stabilized mixture is able to pass through a 1.75 inch sieve.

13. The method of claim 12, further comprising:

spreading said emulsion stabilized mixture to form an emulsion stabilized layer.

14. The method of claim 13, further comprising:

compacting said emulsion, stabilized layer.

15. The method of claim 14, further comprising:

performing nuclear density testing on a said emulsion stabilized layer to establish roller patterns for maximum achievable density.

16. The method of claim 15, further comprising:

compacting said emulsion stabilized layer to at least 97% of said maximum achievable density.

17. The method of claim 12, wherein said subgrade layer is analyzed by measuring the resilient modulus and R value of said subgrade layer at more than one temperature.

18. The method of claim 12, wherein said emulsion stabilized mixture has a gyratory compaction of at least 30 gyrations at a 1.25° angle and 600 kPa, at least 80% coating, at least 1800 lb initial Marshall stability at 25° C. after 24 hours, at least 2500 lb cured Marshall stability at 25° C., and at least 1000 lb cured Marshall stability at 25° C. after soaking.

19. The method of claim 12 wherein the resilient modulus or R value of said borings is measured.

20. The method of claim 12, wherein the amount of said emulsion used is computed by determining if coating and dispersion of said gravel or dirt are within acceptable moisture limits.

21. The method of claim 12, further comprising:

adding said emulsion to said gravel or dirt to adjust the resilient modulus of said gravel or dirt.

22. The method of claim 12, further comprising:

adding aggregate or additives to said gravel or dirt to lower the plasticity index or raise the sand equivalence.

23. The method of claim 12, further comprising:

designing a wearing surface mix for said roadway that meets desired moisture susceptibility and thermal cracking requirements.

24. The method of claim 23, wherein said wearing surface has a gyratory compaction of at least 30 gyrations at a 1.25° angle and 600 kPa and at least 70% retained stability base on cured stability at 40° C.

25. The method of claim 23, further comprising:

determining the needed thickness of said wearing surface; and measuring the resilient modulus of said wearing surface.

* * * * *